US005211050A

United States Patent [19]

Gouveia et al.

[11] Patent Number: 5,211,050

[45] Date of Patent: May 18, 1993

[54] DETENT MECHANISM FOR CONTROLLING POSITION OF ROTATABLE DIE

[75] Inventors: David P. Gouveia, Chester; Armand Montminy; Gary E. Schrader, both of Manchester, all of N.H.

[73] Assignee: Burndy Corporation, Norwalk, Conn.

[21] Appl. No.: 774,803

[22] Filed: Oct. 11, 1991

[51] Int. Cl.[5] ..... H01R 43/042

[52] U.S. Cl. ..... 72/410; 72/413; 72/473; 29/751; 403/96

[58] Field of Search ..... 72/410, 409, 416, 477, 72/473, 413; 269/284, 279, 281, 280, 215; 81/422; 29/751, 750, 758; 403/96, 93, 92; 30/364; 83/552

[56] References Cited

U.S. PATENT DOCUMENTS

| | | | |
|---|---|---|---|
| 49,364 | 8/1865 | Bauer | 72/477 |
| 484,891 | 10/1892 | Fairfield | 30/364 |
| 507,674 | 10/1893 | Connell | 30/364 |
| 1,296,835 | 3/1919 | Monsen | 403/93 |
| 1,308,516 | 7/1919 | Weinstein | 72/410 |
| 1,321,452 | 11/1919 | Ivory | 30/364 |
| 1,338,005 | 4/1920 | Fiftal | 30/364 |
| 1,858,849 | 5/1932 | Borden | 269/279 |
| 2,492,380 | 12/1949 | Duma | 72/477 |
| 2,714,827 | 8/1955 | Kusiv et al. . | |
| 2,726,091 | 12/1955 | Topar | 403/327 |
| 2,729,995 | 1/1956 | Friedman | 72/409 |
| 2,871,744 | 2/1959 | Morrow | 403/327 |
| 3,226,968 | 1/1966 | Holmes . | |
| 3,406,558 | 10/1968 | Tillman | 72/416 |
| 4,118,971 | 10/1978 | Izraeli | 72/410 |
| 4,133,519 | 1/1979 | Shin | 269/279 |
| 4,589,271 | 5/1986 | Laux | 72/410 |
| 4,926,685 | 5/1990 | Shannon, Sr. | 72/410 |

FOREIGN PATENT DOCUMENTS

| | | | |
|---|---|---|---|
| 131267 | 6/1902 | Fed. Rep. of Germany | 83/552 |

*Primary Examiner*—Daniel C. Crane

*Attorney, Agent, or Firm*—Martin P. Hoffman; Burtsell J. Kearns

[57] ABSTRACT

A crimping tool comprises a pair of handles, crimping jaws, dies, and/or die nests, positioned at one end of the handles and in alignment with each other to receive a connector therebetween, a linkage extending between the handles and joining same together such that one handle pivots relative to the other and forces the jaws, dies, and/or die nests toward each other. A rotatable die wheel, with dies, of different sizes and shapes, is located at the forward end of one handle, in alignment with the working surface of a crimping jaw secured to the forward end of a second handle. The die wheel has a plurality of passages extending transversely therethrough. A chamber is formed in one of the handles, and a ball is placed therein. A strap, formed of spring steel, is secured to one of the handles and exerts a biasing force upon the ball. When the die wheel is indexed to place a particular die in operative position, the strap forces the ball to project into one of the passageways, thereby functioning as a detent to retain the die wheel in its indexed position.

5 Claims, 4 Drawing Sheets

DETENT MECHANISM FOR CONTROLLING POSITION OF ROTATABLE DIE

BACKGROUND OF THE INVENTION

The present invention relates generally to crimping tools including a rotatable die wheel with multiple dies and/or die nests for receiving, and retaining, connectors of different sizes to be mechanically, and electrically, secured to conductors positioned therein. More specifically, the present invention pertains to a simplified detent mechanism for retaining the selected die, on the die wheel, in its operative position, relative to an aligned crimping jaw.

SUMMARY OF THE INVENTION

Crimping tools for securing metal connectors to electrical conductors are well known and widely used. A representative crimping tool is shown in U.S. Pat. No. 188,259, granted Jun. 21, 1960, to Howard B. Gibson, and assigned, on its face to The Thomas & Betts Co. Other crimping tools are shown in U.S. Pat. No. 2,952,174 granted Sep. 13, 1960 to William F. Broske, in U.S. Pat. No. 4,118,971, granted Oct. 10, 1978, to Hyman Izraeli, and in U.S. Pat. No. 4,926,685, granted May 22, 1990, to John K. Shannon, Sr.

Known crimping tools generally include a first handle, a second handle and a mechanical linkage located intermediate the first and second handles to allow pivotal movement therebetween, a first die or die nest secured to the remote end of the first handle, and a second die secured to the remote end of the second handle in alignment with the first die. A torsion spring biases the handles apart so that a connector can be inserted therein into an aperture defined between the dies.

After a conductor is introduced into the connector, and is properly aligned therewithin, the ends of the handles remote from the dies are operated, manually, in a plier-like manner. The crimping pressure exerted by the dies upon the connector radially indents same, and mechanically, and electrically, joins the connector to the conductor. After each crimping operation, the torsion spring disposed between the handles urges the handles to swing apart, to an open position, so that the connector and conductor can be removed from the dies.

In order to increase the versatility of crimping tools, thereby allowing the same tool to receive, and accurately crimp, connectors of different sizes, die wheels having cavities of different sizes were introduced. Such die wheels could be adjusted manually, by the user of the tool, so that the cavity in the die wheel of the desired size would be indexed into alignment with the crimping jaw of the tool. One example of a known adjustable die wheel, with multiple cavities, is shown in U.S. Pat. No. 2,952,174, cited above. A second example of a known adjustable die wheel is shown in U.S. Pat. No. 4,118,971, cited above.

However, known crimping tools with adjustable die wheels, with multiple cavities, required two handed operation which, in turn, required a fair degree of manual dexterity. Usually, one hand would be needed to release the detent mechanism retaining the die wheel in its indexed position, while the other hand would be needed to advance, or retract, the die wheel to a new position.

Additionally, known detent mechanisms were relatively complex, and the costs associated with manufacturing, and assembling, such mechanisms contributed to the costs of the crimping tool incorporating such mechanism.

In contrast thereto, the present detent mechanism is fabricated from a minimum number of components, is easy to operate, functions satisfactorily under all operating conditions, even on the job site. Furthermore, the present detent mechanism lends itself to one handed operation by the user of the tool, and once indexed, remains locked in place so that the accuracy and reliability of the crimping operations performed by the tool is enhanced.

Furthermore, the present invention will be incorporated into a new series of versatile crimping tools, and can be retrofitted onto existing tools, thus expanding the commercial potential for such invention.

Other advantages and benefits that flow from the present invention will become readily apparent to the artisan, when the appended drawings are construed in harmony with the detailed specification.

DESCRIPTION OF THE PREFERRED EMBODIMENT

Figure 1:
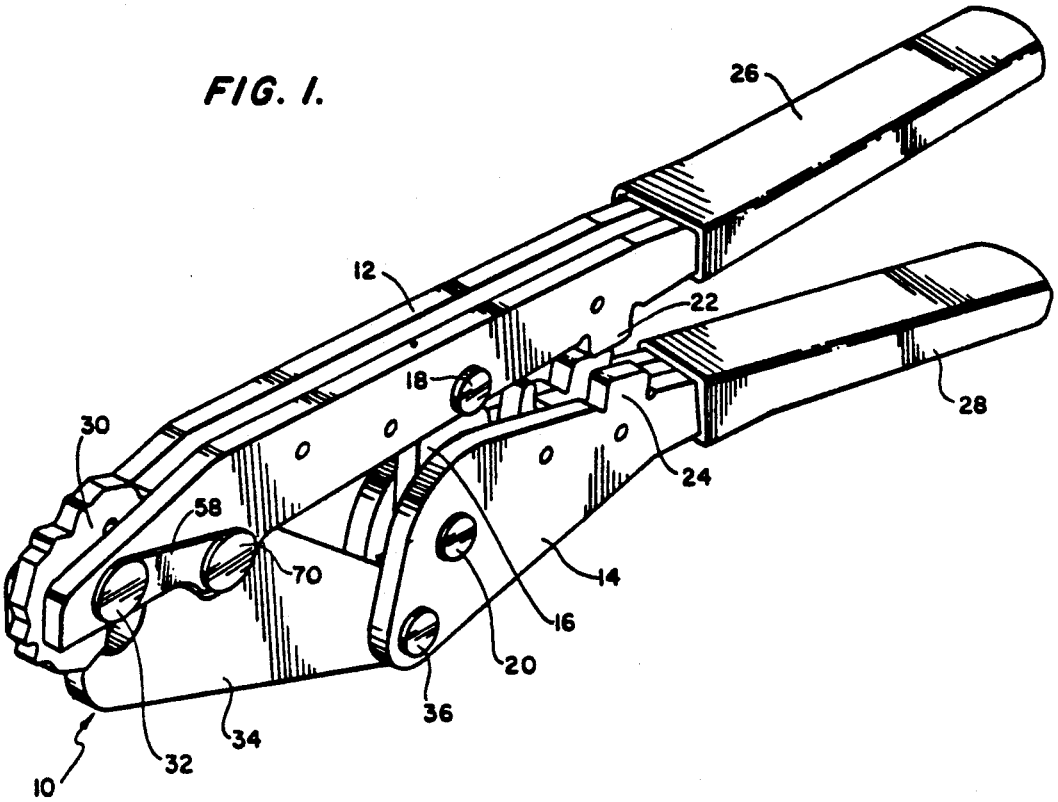
FIG. 1 is a perspective view of a crimping tool including a rotatable die wheel and a detent mechanism therefor configured in accordance with the principles of the present invention.

FIG. 1 depicts a crimping tool 10 employing a rotatable die wheel operatively associated with a detent mechanism constructed in accordance with the principles of the present invention. Tool 10 comprises a first handle 12, a second handle 14, and a link 16 that joins the handles together. An upper pin 18 passes through the first handle and an aperture in link 16, so that the link is secured to the first handle. A lower pin 20 passes through the second handle and a different aperture in link 16, so that the link is secured to the second handle. Link 16 pivots about pins 18, 20 as the handles are brought toward one away, or separated therefrom, and opposing stops 22, 24 limit the movement of the handles toward one another.

A first plastic sleeve 26 is slipped over the rear end of handle 12, and a second plastic sleeve 28 is slipped over the rear end of handle 14. A rotatable die wheel 30 is situated at the forward end of handle 12, and a pin 32 extends transversely across the handle and through a central aperture in the die wheel. A crimping jaw 34 is located at the forward end of handle 14, and a pin 36 extends transversely across the handle and through an aperture in the jaw 34. The jaw pivots about pin 36 and cooperates with die wheel 30.

Figure 2:
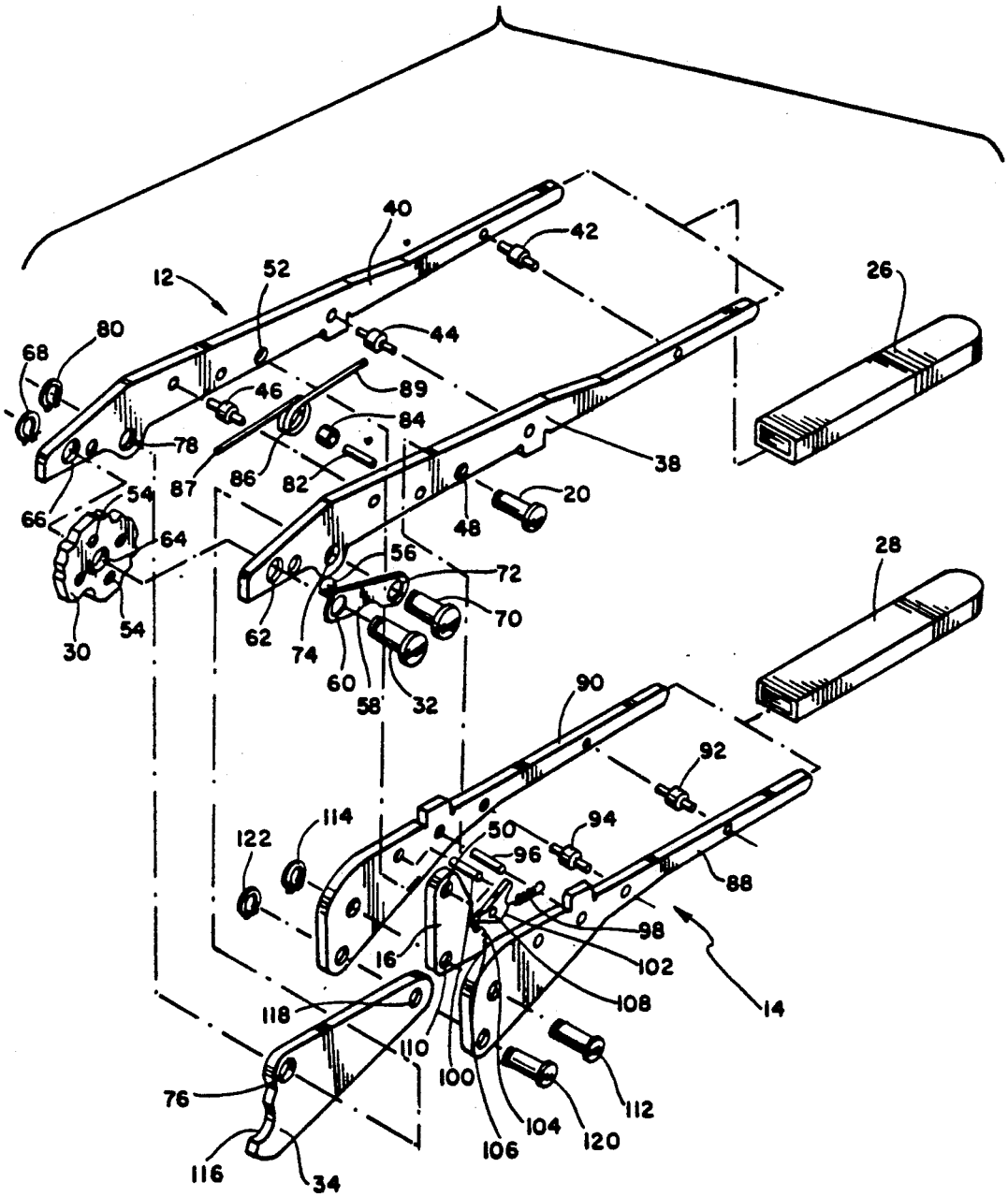
FIG. 2 is an exploded perspective view of the crimping tool of FIG. 1.

The exploded perspective view of FIG. 2 shows additional details of the construction of crimping tool 10. For example, first handle 12 is formed from a pair of identically configured plates 38, 40 that are retained in parallel relationship by spacers 42, 44 and 46. Each spacer has an enlarged central section with a cylindrical peg extending from opposite sides thereof; each peg fits into an aperture in plates 38, 40. Pin 20 passes through aperture 48 in plate 38, through aperture 50 in link 16, and thence exits the tool through an aligned aperture 52 in plate 40. An enlarged head may be formed at one end of pin 20, and a metal clip may fit into a groove (not shown) at the opposite end thereof, to maintain the pin in a fixed position relative to link 16.

Die wheel 30 has dies, or die nests, of different configurations and/or depths spaced radially about its periphery. The dies enable the tool 10 to receive, and retain, a variety of connectors in fixed relationship to the working surface of crimping jaw 34. A plurality of passageways 54 are formed transversely through the wheel 30, and a ball 56 is urged by flexible metal strap 58 into one of the passages. Ball 56, strap 58, and passages 54 cooperate to define a unique detent mechanism to retain the die wheel in the position to which it has been indexed.

Pin 32 extends transversely through an aperture 60 formed in strap 58, through an aperture 62 formed at the forward end of plate 38, through a central aperture 64 in die wheel 30, and through the aligned aperture 66 at the forward end of plate 40. One end of pin 32 has an enlarged head, while the opposite end of pin 32 is retained in position by metal clip 68. Die wheel 30 is indexed about pin 32 intermediate spaced parallel plates 38 and 40.

Another pin 70 passes through a second aperture 72 in strap 58, through an opening in ear 74 in plate 38, and thence through an aperture 76 near the forward end of jaw 34. Pin 70 extends through an opening in ear 78 in plate 40. One end of pin 70 has an enlarged head, while the opposite end of the pin is held in fixed position by metal clip 80.

A stub shaft 82 is situated between spacers 44, 46, and the opposite ends of the shaft fit into aligned apertures in parallel plates 38, 40, respectively. A cylindrical sleeve 84 is slipped over shaft 82, and the coiled, central section of torsion spring 86 fits over sleeve 84. The legs 87, 89 of spring 86 extend, in opposite axial directions, away from the central section of the spring. To illustrate, the forwardly extending leg 87 contacts one side of the link 16, while the rearwardly extending leg 89 passes beneath spacer 44.

Second handle 14 is also formed from a pair of identically configured plates 88, 90 that are retained in parallel relationship by spacers 92, 94. Opposite ends of the spacers are received in aligned apertures in the plates, which are maintained in a parallel, spaced apart, relationship. Stub shaft 96 extends between aligned apertures in plates 88 and 90, and one end of a coil spring 98 is anchored to shaft 96. A second stub shaft 100 extends between aligned apertures in plates 88 and 90, and a pawl 102 with an opening 104 therethrough is mounted on stub shaft 100 for pivotal movement relative thereto. The opposite end of spring 98 is secured to pawl 102 to bias same toward link 16.

Link 16 is substantially triangularly-shaped, when viewed in side elevation. A series of teeth 106, and a recess 108, are defined on the downwardly sloping face of the link. Pawl 102 cooperates with teeth 106 and recess 108, to ensure that the crimping operation of the tool has been completed before the jaws can be opened.

In addition to aperture 50 near the apex of triangular link 16, a second aperture 110 is formed therethrough at the lower, forward edge of the link. A pin 112 extends through aligned apertures in plates 88, 90 and passes through aperture 110 in link 16. Pin 112 may have an enlarged head, and a metal clip 114 fits into a groove (not shown) at the opposite end of the pin to securely lock same into position.

Crimping jaw 34 is secured by pin 70, which passes through aligned apertures in the ears 74, 78 of plates 38, 40 of handle 12, for pivotal movement about pin 70 and relative to handle 12. Jaw 34 is mounted in alignment with die wheel 30 for cooperation therewith; the working surface 116 on jaw 34, which may be work hardened, tempered, or otherwise treated to increase its life, delivers a radially directed crimping force to a connector (not shown) retained in the aligned die, or die nests in die wheel 30.

An opening 118 is formed near the rear end of crimping jaw 34, and a pin 120 passes through the aligned openings near the forward ends of plates 88, 90, and through opening 118, as well. Pin 120 may have an enlarged head at one end, and a metal clip 122 is seated upon the opposite end of the pin. The enlarged head and clip seat the pin and retain same in fixed position so that jaw 34 can pivot relative to pin 120. Sleeve 28 is slipped over the rear ends of plates 88, 90, so that the tool can be comfortably gripped, and manipulated, by the user.

Figure 3:
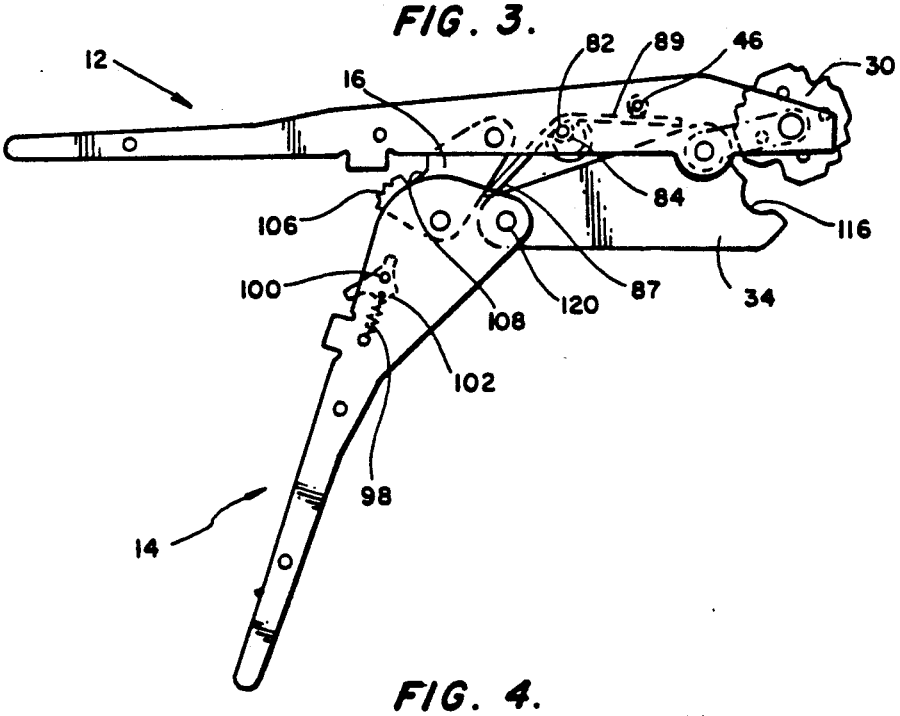
FIG. 3 is a side elevational view of the crimping tool of FIG. 1, with the tool in the opened position.
Figure 4:
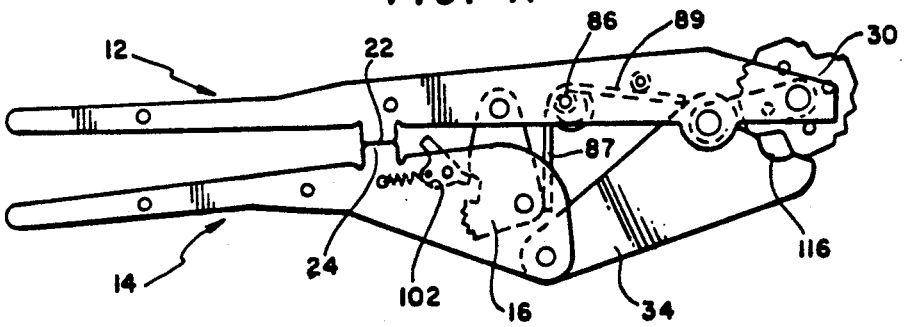
FIG. 4 is a side elevational view of the crimping tool of FIG. 1, with the tool in the closed position.

FIGS. 3 and 4 illustrate the manner in which the crimping tool is operated. Handle 14 is pivoted, or swung, counterclockwise, thus pivoting jaw 34 away from die wheel 30. Die wheel 30 is indexed so that a die of the desired size is positioned opposite working surface 116 on jaw 34. A connector (not shown) is placed in the selected die in the die wheel, and a conductor (not shown) is inserted into the connector. The forwardly extending leg 87 of torsion spring 86 is retained by spacer 46, while the rearwardly extending leg 89 of spring 86 presses against link 16.

When manual pressure is applied by the operator, or user, of the tool, as by a squeezing motion, handle 14 pivots clockwise about pin 112 toward handle 12. During the course of its clockwise movement, pawl 102 engages teeth 106 on link 16. The pawl advances upwardly along teeth 106, so that the closing action of the jaws continues until jaw 34 has fully imparted its radially directed crimping force to the connector and conductor retained in the selected die. As pawl 102 advances beyond the uppermost tooth, the pawl enters recess 108, and, under the urging of biasing spring 98, pivots out of operative engagement. The handles 12, 14 are closed, so that stops 22, 24 are in abutting relationship.

Leg 89 on spring 86 has been flexed inwardly, or counterclockwise, over an arc of several degrees, during the closing movement of the handles of the tool. When the operator, or user, discontinues the squeezing pressure previously imparted to the tool, spring 86 relaxes and returns to its normal, unstressed condition. Leg 89 presses against link 16, which pivots clockwise about pin 18, so that handle 14 is biased toward the open position of the tool shown in FIG. 3. The tool can be opened, and operated, without reliance upon spring 86; however, the restoring force imparted by spring 86 makes tool operation easier, and less fatiguing to the user. Leg 89 of spring 86 is flexed each time the handle 14 is pivoted to its closed, or crimping, position, and spring 86, if properly designed, fabricated, and assembled, may serve as a simple, mechanical indicator for the number of cycles of operation of the crimping tool.

Figure 5:
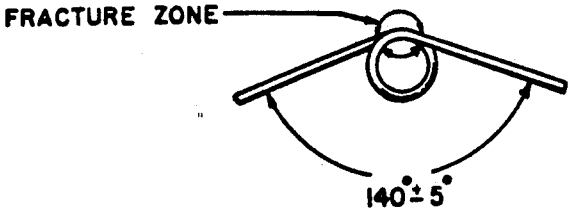
FIG. 5 is a front elevational view, on an enlarged scale, of a torsion spring employed in the tool of FIG. 1.

FIG. 5 shows one configuration of a torsion spring 86, with legs 87 and 89, extending in opposite directions. The central portion of spring 86 consists of one turn of spring steel. The spring is designed to fracture cleanly in the area intermediate the legs 87, 89; such area, which may be augmented by scoring or metal embrittlement techniques, as necessary, fractures cleanly when a predetermined number of cycles of tool operation have been effectuated. In one prototype crimping tool, for example, with the legs 87, 89 separated by approximately 140° in the normal, unstressed condition, spring 86 fractured after 45,000 to 55,000 cycles of operation; the crimping tool utilizing spring 86 was designed to achieve crimping operations, within the dimensional tolerances established for the crimped connections, over a life span of 60–70,000 cycles. Thus, torsion spring 86 fractured at a time in the operational life of the crimping tool when the tool was still functioning satisfactorily. The fracture of spring 86 is readily detected by the user of the tool, for while the tool can still be opened and closed manually, far greater effort was needed to open the tool, without the assistance, or urging, of spring 86. The user is thus forewarned that the crimping tool needs inspection, maintenance, and perhaps, replacement, if acceptable crimped connections are to be made, in futuro.

Figure 7:
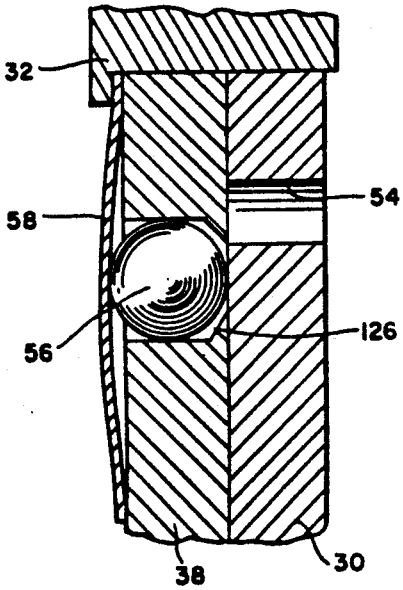
FIG. 7 is a front elevational view of the die wheel and detent mechanism of FIG. 6, such view, however, being taken on an enlarged scale to show the die wheel being indexed relative to the detent mechanism.
Figure 6:
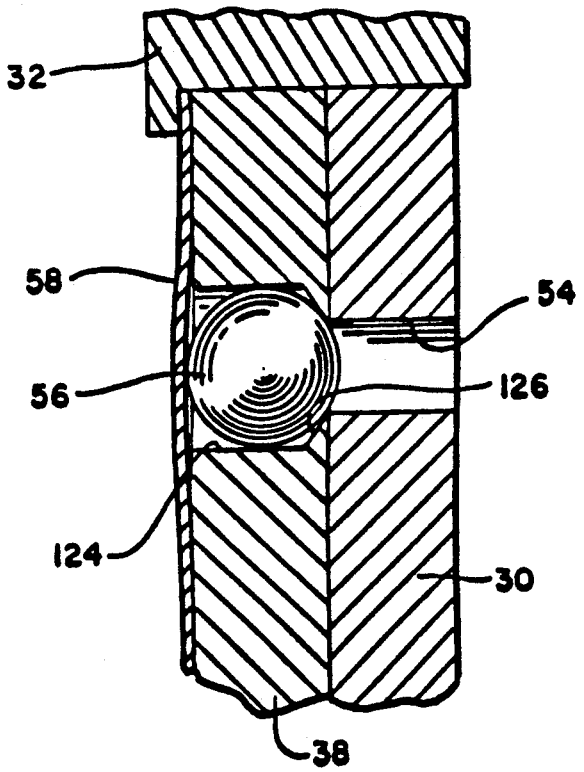
FIG. 6 is a front elevational view of a fragment of the rotatable die wheel and the detent mechanism operatively associated therewith, such view being taken on an enlarged scale to show the die wheel retained in fixed position.

FIGS. 6 and 7 show the details of the unique detent mechanism that is operatively associated with die wheel 30. Wheel 30 has several dies, or die nests, defined about its perimeter to receive therein connectors of different sizes. Die wheel 30 is situated between parallel spaced plates 38, 40 of first, or upper, handle 12, and cooperating crimping jaw 34 is situated between parallel spaced plates 88, 90 of second, or lower, handle 14. Consequently, the working surface 116 of crimping jaw 34 can impart a radially directed crimping force to a connector (not shown) retained in the gap, or aperture, defined between the adjacent, coacting surfaces of the crimping tool. Such aperture is visible in FIG. 4.

FIG. 6 shows the rotatable die wheel 30 held in a fixed position by the detent mechanism. Ball 56 is retained in a chamber 124 in plate 38 in the vicinity of wheel 30; a seat 126, of reduced diameter, is formed at the inner end of the chamber. Strap 58, is made of durable, long-lived, spring steel, and is retained in position by pins 32 and 70. The strap exerts a biasing force upon ball 56. Ball 56, under the urging of strap 58, moves inwardly and engages seat 126, and projects partially into the aligned passageway 54 in die wheel 30. The ball thus serves as a detent to temporarily retain the die wheel in indexed position. Strap 58 bows slightly outwardly, but maintains a biasing force upon ball 56 at all times. The slight bowing of the strap is shown in FIG. 6.

In order to index the rotatable die wheel 30, the operator manually applies a rotational force to the die wheel. The force necessary to index wheel 30 can easily be supplied by one hand of the operator, so that the other hand may grasp the tool, and hold same steady. As shown in FIG. 7, the rotational force applied to die wheel 30 forces, or cams, ball 56 away from seat 126; the ball, in turn, causes a greater deformation in strap 58; the strap is resilient and the deformation is well below its elastic limit. When the die wheel has been indexed to the desired, or selected, position, strap 58 forces, or urges, ball 56 against seat 126 so that a portion of ball 56 extends into one of the passageways 54 in die wheel 30. Strap 58 flexes inwardly, with a loud audible click, that informs the operator that the die wheel 30 has been indexed to the selected position.

The wear characteristics of the spring steel selected for strap 58 are such that the strap will function satisfactorily for several thousands of cycles, and will undoubtedly function satisfactorily over the life of the tool. The deformation of strap 58 is visible to the user of the tool, as a means to insure proper operation. Furthermore, the resiliency of the spring steel is such that the audible clicking sound will be clearly heard by the operator as the rotatable die wheel is indexed, and then retained, in its selected position. Lastly, the operator can "feel" the action of ball 56 as same is forced inwardly, by strap 58, into one of the passageways 54 extending clean-through die wheel 30.

The foregoing description of the present invention should be considered as illustrative in nature. The size, number, and location of the passageways 54 extending transversely through die wheel 30 are only suggestive of other configurations that might be used in conjunction with the unique, simple, yet effective detent mechanism. For example, dimples in one face of the die wheel might be utilized in lieu of passageways 54. The die wheel might have die nests, rather than dies formed thereon, and rotatable dies, or die nests, might be secured to both handles of the crimping tool. Consequently, the appended claims should not be limited to their literal terms, but should be broadly construed in a manner consistent with the significant advance, in the useful arts and sciences, to which the present invention appertains.

What is claimed is:

1. A crimping tool comprising:

a) a first handle having a forward end and a rearward end, b) a die wheel, with recesses of different sizes defined about its periphery rotatably secured about a transverse axis at the forward end of said first handle, c) a second handle having a forward end and a rearward end, d) a jaw with a crimping surface secured to the forward end of said second handle in alignment with said die wheel, e) said crimping surface and said die wheel defining an aperture therebetween adapted to receive a connector therewithin for the crimping operation, f) means for securing said handles together so that said handles can pivot relative to one another, g) the invention being characterized in that a plurality of transversely opening passageways are defined within said die wheel to permit indexing of said die wheel, h) a chamber is defined within the forward end of said first handle in proximity to said die wheel, the chamber opening onto opposite sides of the first handle, i) a ball movable generally parallel to said transverse axis within said chamber, j) a separate resilient metal strap is secured to the forward end of said first handle adjacent to said chamber and overlying the opening on one side of said first handle, k) said metal strap constantly urging said ball within said chamber toward the opening on the other side of said first handle, and toward said passageways in said die wheel to engage said passageways and retain said die wheel in its indexed position and l) said ball is movable relative to, and in direct contact with, said strap.

2. A crimping tool as defined in claim 1 further characterized in that said first handle comprises a pair of identical plates, spacers retain said plates in parallel relationship, and said die wheel is retained between said plates.

3. A crimping tool as defined in claim 2 further characterized in that an aperture is formed through the central axis of said die wheel, aligned apertures are formed in said identical plates, and a pin extends through said plate and said die wheel to mount said die wheel for rotational movement.

4. A crimping tool as defined in claim 2 further characterized in that said second handle comprises a second pair of identical plates, and said jaw with a crimping surface is mounted between said second pair of plates in operative alignment with said die wheel.

5. A crimping tool as define din claim 3 wherein an aperture is formed in said resilient metal strap, and said pin extends through said strap to secure same to said first handle in operative relationship to said bal and to said chamber.

* * * * *